US007256809B2

(12) United States Patent
Goto et al.

(10) Patent No.: US 7,256,809 B2
(45) Date of Patent: Aug. 14, 2007

(54) THERMAL PRINTER HAVING HEAT RADIATION PLATE

(75) Inventors: Takashi Goto, Fukushima-ken (JP); Yasutoshi Inoue, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 233 days.

(21) Appl. No.: 11/087,954

(22) Filed: Mar. 22, 2005

(65) Prior Publication Data

US 2005/0212897 A1 Sep. 29, 2005

(30) Foreign Application Priority Data

Mar. 26, 2004 (JP) ..... 2004-092384
Jun. 24, 2004 (JP) ..... 2004-186783

(51) Int. Cl.
*B41J 25/312* (2006.01)

(52) U.S. Cl. ..... 347/198

(58) Field of Classification Search ..... 347/197, 347/198; 400/120.16, 120.17
See application file for complete search history.

(56) References Cited

U.S. PATENT DOCUMENTS 5,502,477 A 3/1996 Osada et al.
5,594,487 A * 1/1997 Nuita et al. ..... 347/197
5,746,519 A * 5/1998 Ricketts ..... 400/120.01
6,031,599 A 2/2000 Sheng et al.
6,118,468 A 9/2000 Ando et al.

FOREIGN PATENT DOCUMENTS

JP 5-309907 11/1993
JP 10181148 10/1998

* cited by examiner

*Primary Examiner*—Huan Tran
(74) *Attorney, Agent, or Firm*—Brinks Hofer Gilson & Lione

(57) ABSTRACT

A thermal printer includes a rotatable platen roller; an elongated thermal head which is movable toward or away from the platen roller; and a head supporting member having an elongated head supporting portion for supporting the thermal head formed at an end. A heat radiation plate through which heat generated from the thermal head during printing can escape is arranged between the thermal head and the head supporting portion, and the thermal head can be adjustably curved toward the platen roller via the heat radiation plate by an adjusting member arranged in the head supporting portion.

13 Claims, 3 Drawing Sheets

THERMAL PRINTER HAVING HEAT RADIATION PLATE

This application claims the benefit of priority to Japanese Patent Application Nos. 2004-092384 filed on Mar. 26, 2004 and 2004-186783 filed on Jun. 24, 2004, both herein incorporated by reference.

BACKGROUND OF THE INVENTION

1. Field of the Invention

The present invention relates to a thermal printer which is suitable for performing printing on a recording paper by selectively generating heat from a plurality of heating elements of a thermal head based on print information.

2. Description of the Related Art

A conventional thermal printer 51 will now be described with reference to FIGS. 5 and 6, a cylindrical platen roller 52 is rotatably supported on a frame side which is not shown. Also, above the platen roller 52, a rectangular thermal head 53 composed of line heads capable of moving toward or away from (head up/down) the platen roller 52 is arranged.

The thermal head 53 is composed of a head substrate 53*a* which has a plurality of heating elements (not shown) formed on the bottom of the drawing, a head mount 53*b* on which the head substrate 53*a* is mounted, and a ribbon separation plate 53*c*.

Also, the thermal head 53 is supported by a head supporting member 54 so as to be movable toward and away from the platen roller 52. The head supporting member 54 includes a first head supporting member 55 having first substantially U-shaped arm portions 55*a* that face each other, a second head supporting member 56 having second substantially U-shaped arm portions 55*a* that are formed outside and face the first arm portions 55*a*.

The first head supporting member 55 is made of materials such as aluminum whose heat radiation performance is satisfactory, a flat plate head supporting portion 55*b* which also serves as a heat radiation plate is integrally formed at the ends of the first arm portions 55*a*. A heat radiation portion 55*c* is formed by protrusions extending from the head supporting portion 55*b* to increase the surface area of the first heat radiation portion 55*c*.

Also, in the first head supporting member 55, both ends of the thermal head 53 in the longitudinal direction are mounted below the head supporting portion 55*b*, wherein heat generated during printing operation escapes from the heat radiation portion 55*c* via the head supporting portion 55*b* that also serves as a heat radiation plate.

Also, in the second head supporting member 56, outside ends of the second arm portions 56*a* are integrally formed by connecting to an urging portion 56*b* with screws. A coil spring 57 is arranged between the urging portion 56*b* and the head supporting portion 55*b* of the first head supporting member 55, wherein the thermal head 53 mounted in the head supporting portion 55*b* is elastically urged toward the platen roller 52.

Also, in the first head supporting member 55, a pair of stopper portions 55*d* is curved and folded in a nonlinear form to prevent a gap between the head supporting portion 55*b* and the urging portion 56*b* from increasing by the urging force of the coil spring 57.

Also, in the first head supporting member 55, an adjusting screw 58 capable of adjusting the warpage of the thermal head 53 is fixed to the center position of the head supporting portion 55*b* in the longitudinal direction.

Also, in the first head supporting member 55, a first supporting hole 55*f* which is elongated in the vertical direction in the drawing is formed at ends of the first substantially U-shaped arm portions 55*a*, and a second circular supporting hole 56*c* is formed at ends of the second arm portions 56*a* located outside the first supporting hole 55*f*.

Also, in the second head supporting member 56, a rod-shared urging portion 56*d* is protrudingly formed of the second arm portions 56*a*. The urging portion 56*d* is designed to be engaged with an urging member (not shown) arranged at the frame side.

Also, in the head supporting member 54, the first and second supporting holes 55*f* and 56*c* are supported by a supporting shaft (not shown) formed at the frame side, and when being rotated downward by the urging means, the thermal head 53 is turned down and can be pressure-contacted to the platen roller 52 by the urging force of the coil spring 57.

Also, in the thermal head 53, the center portion in the longitudinal direction is bent downward, so as to prevent from being wrinkled an ink ribbon (not shown), which is pressure-contacted to the platen roller 52 by a recording paper when the printing operation is performed.

However, in the conventional thermal printer 51, because the adjusting screw 58 is supported by the head supporting portion 55*b* which also serves as a heat radiation plate, when the thermal head 53 is bent by tightening the adjusting screw 58, the center portion along the longitudinal direction of the head mount 53*b* is separated from the head supporting portion 55*b* and a gap 59 is formed therebetween.

Because of this, heat generated from the thermal head 53 during printing can not easily escape through the head supporting portion 55*b* which also serves as a heat radiation plate, resulting in the thermal head 53 heating up during the printing process, thus possibly deteriorating the quality of an image printed on a recording paper.

Also, in the first head supporting member 55, because the first arm portions 55*a*, the head supporting portion 55*b* and the heat radiation portion 55*c* are made of materials such as aluminum whose heat radiation performance is satisfactory, thus the cost increases.

Furthermore, the thickness of the head supporting portion 55*b* made of materials like aluminum must be thick because the thermal head 53 is bent by tightening the adjusting screw 58, which increases the cost.

SUMMARY OF THE INVENTION

An advantage of the present invention is that it provides a thermal printer capable of radiating heat generated from a thermal head while printing a high image quality and reducing cost.

According to a first aspect of the present invention, the thermal printer includes a rotatable platen roller; an elongated thermal head which is movable toward or away from the platen roller; and a head supporting member having an elongated head supporting portion for supporting the thermal head formed at an end. A heat radiation plate, through which heat generated from the thermal head during printing can escape, is arranged between the thermal head and the head supporting portion. The thermal head can be adjustably curved toward the platen roller via the heat radiation plate by an adjusting member arranged in the head supporting portion. By this, because the thermal head can be curved in a state adhering closely to the heat radiation plate, heat generated from thermal head during printing can reliably escape via the heat radiation plate, thus the thermal head can be immediately cooled down to an appropriate temperature for printing. It is, therefore, possible to print excellent quality images at a high rate of speed.

Further, according to a second aspect of the invention, the heat radiation plate is composed of a rectangular head fixing portion for fixing the thermal head, a heat radiation portion having a wide surface extending from the head fixing portion. The head fixing portion is supported by the head supporting portion, then by curving the center portion in the longitudinal direction of the head fixing portion with the adjusting member, wherein the thermal head can be adjustably curved. By this, the thermal head can be reliably curved along the curved heat radiation plate. The thermal head always adheres closely to the heat radiation plate, and thus heat from the thermal head immediately and reliably escapes via the heat radiation plate.

Furthermore, according to a third aspect of the invention, the head fixing portion has slit grooves formed at a predetermined interval in the center portion in a direction orthogonal to the longitudinal direction, a pressing portion between the slit grooves can be pressed by the adjusting member. By this, because the heat radiation plate can be curved at the slit grooves with little strength, and the thickness of the flat plate head supporting portion that supports the adjusting member can be made thin, it is possible to reduce the cost of the materials. Further, by the slit grooves, the head fixing portion can be securely curved in the form of a mountain, and thus an ink ribbon can be prevented from being wrinkled when the printing is performed.

Moreover, according to a fourth aspect of the invention, the adjusting member is composed of screw members screwed to the head supporting portion, and by screwing the screw members, the thermal head can be adjustably curved via the heat radiation plate. By this, the curve adjustment of the thermal head becomes easy.

In addition, according to a fifth aspect of the invention, the head supporting member has arm portions capable of supporting both ends along the longitudinal direction of the head supporting portion. The arm portion has a rotation supporting portion formed opposite to the head supporting portion, and by rotating around the rotation supporting portion as a fulcrum, the head supporting portion is movable toward or away from the platen roller. By this, the thermal head can reliably pressure-contact the platen roller.

DETAILED DESCRIPTION OF THE PREFERRED EMBODIMENTS

Figure 1:
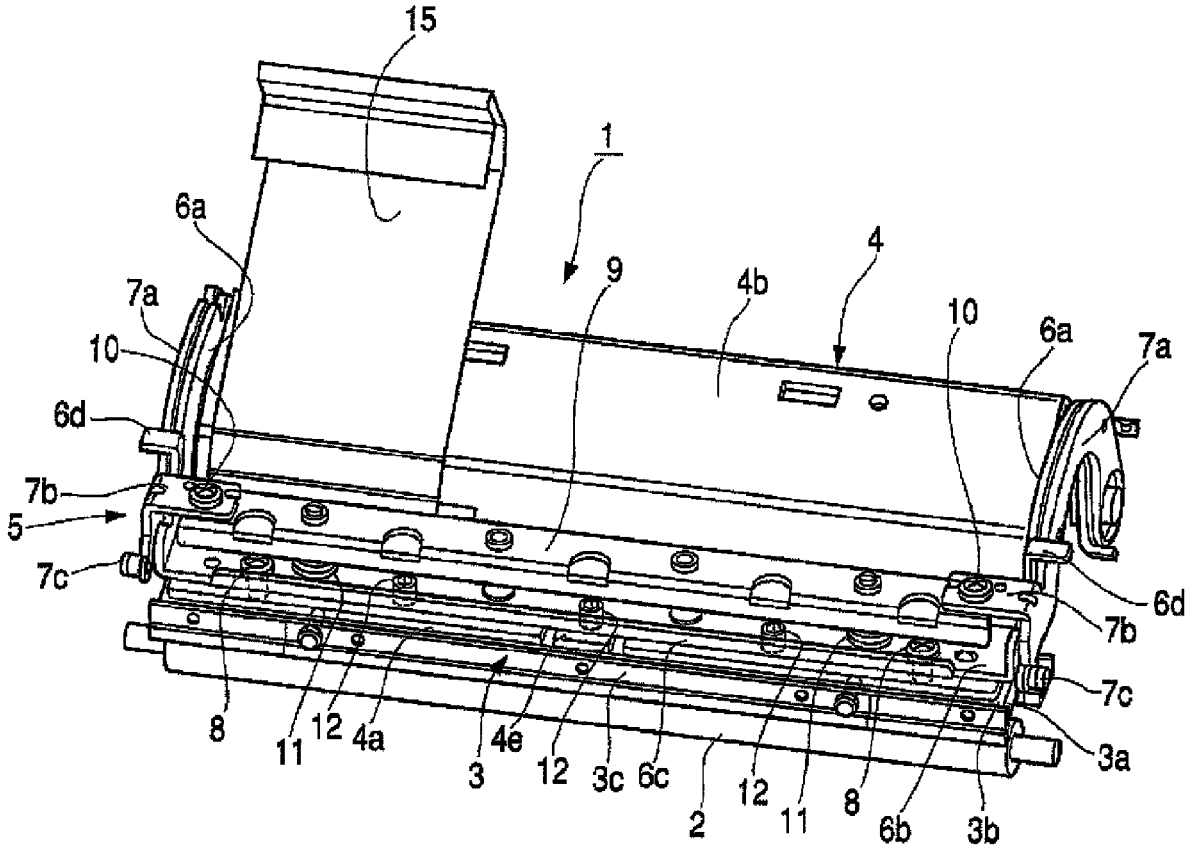
FIG. 1 is a perspective view showing a printing part of a thermal printer of the present invention.
Figure 3:
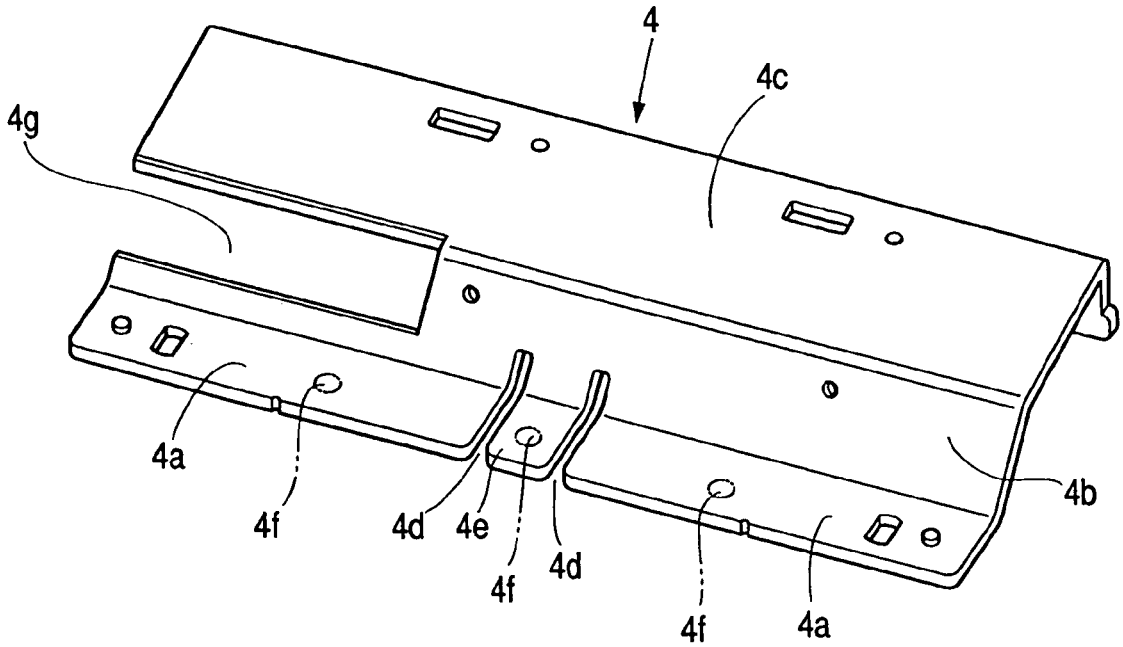
FIG. 3 is a perspective view showing a heat radiation plate according to the present invention.
Figure 4:
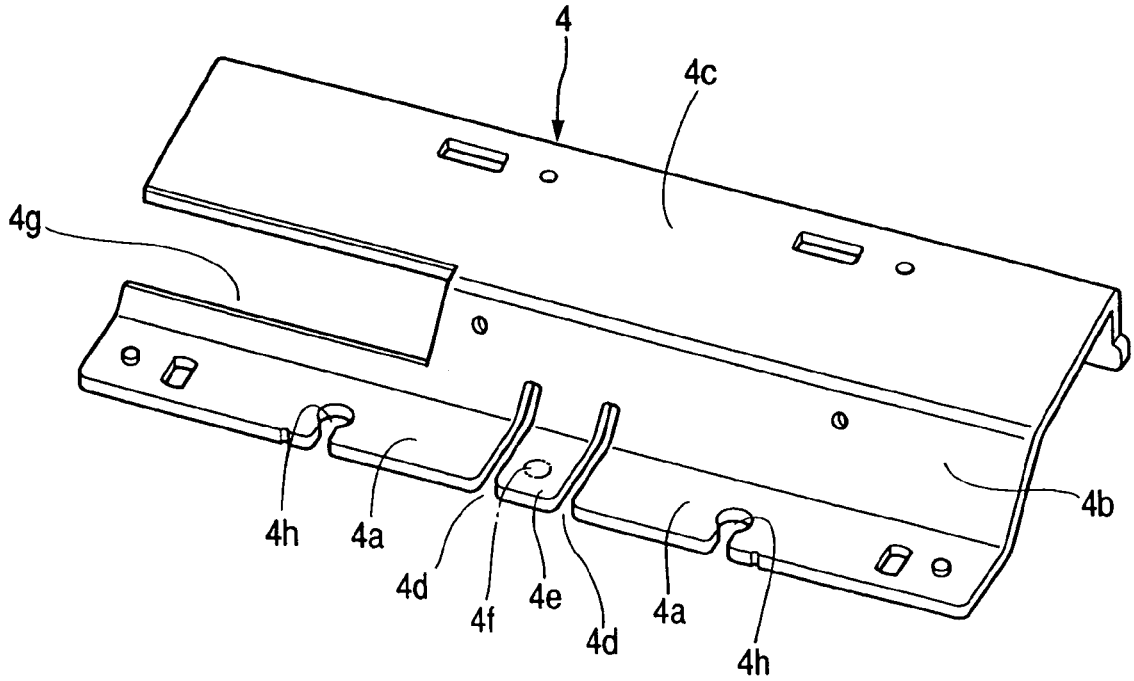
FIG. 4 is a perspective view showing a modification of a heat radiation plate according to the present invention.
Figure 5:
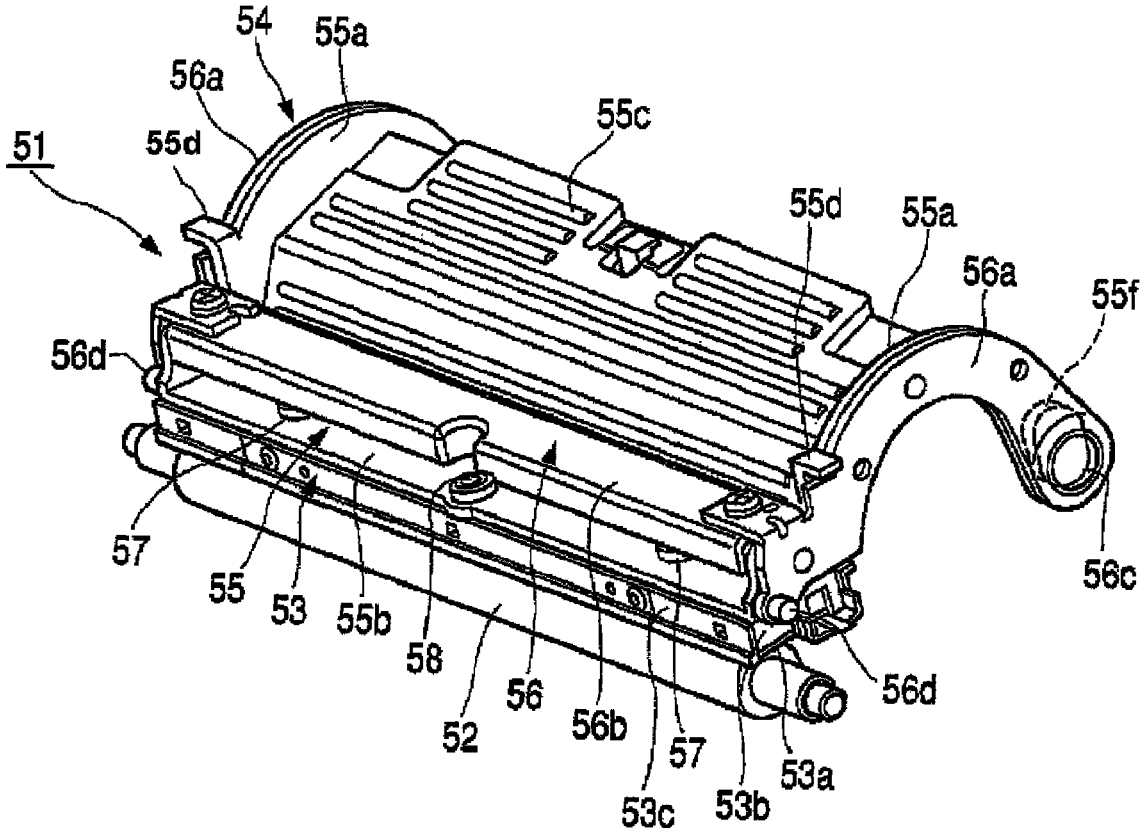
FIG. 5 PRIOR ART
FIG. 5 is a perspective view showing a printing part of a conventional thermal printer.
Figure 6:
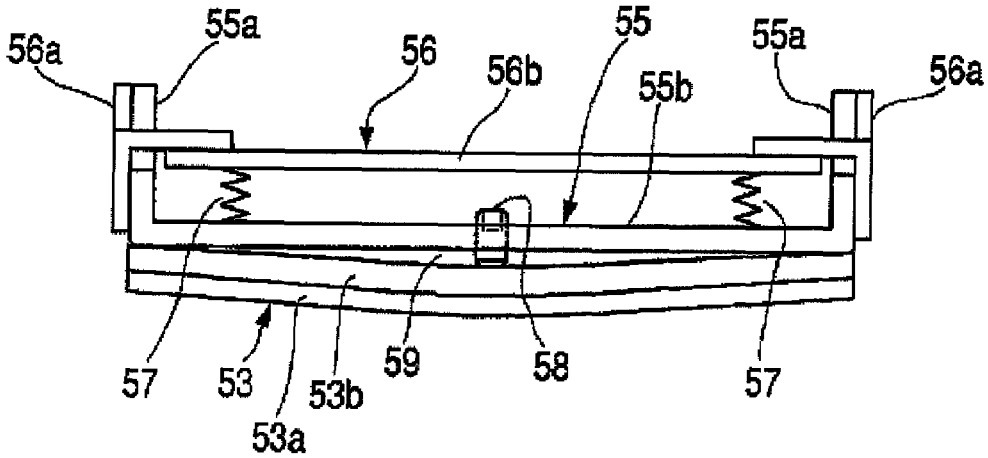
FIG. 6 PRIOR ART
FIG. 6 is a diagrammatic plan view of FIG. 5.

Hereinafter, a preferred embodiment of a thermal printer of the present invention will now be described with reference to the accompanying drawings. FIG. 1 is a perspective view showing a printing part 1 of a thermal printer, FIG. 2 is a diagrammatic plan view of FIG. 1, FIG. 3 is a perspective view showing a heat radiation plate, and FIG. 4 is a perspective view showing a modification of a heat radiation plate according to the present invention.

First, the thermal printer of the present invention will be described with reference to FIGS. 1 to 3. An elongated cylindrical platen roller 2 is rotatably supported on the frame side (not shown).

Also, above the platen roller 2, an elongated cylindrical thermal head 3 composed of line heads being movable toward or away from (head up/down) the platen roller 2 is arranged.

Figure 2:
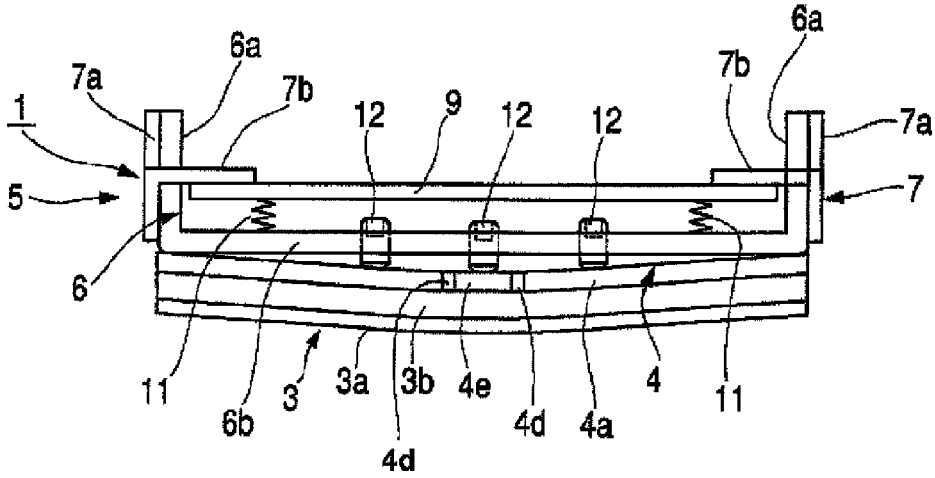
FIG. 2 is a diagrammatic plan view of FIG. 1.

As shown in FIG. 2, the thermal head 3 includes a head substrate 3*a* which has a plurality of heating elements (not shown) arranged in a row at the bottom, the substrate 3*a* is bonded to a head mount 3*b* made of aluminum or the like with a high thermal conductive adhesive. At the front side of the thermal head 3 in FIG. 3, a separation plate 3*c* is fixed with screws or the like and separates an ink ribbon contacted to a recording paper (not shown) during printing.

Further, above the head mount 3*b*, a heat radiation plate 4 made of aluminum or the like is bonded with a high thermal conductive adhesive.

In the heat radiation plate 4, as shown in FIG. 3, a rectangular head fixing portion 4*a* for fixing the head mount 3*b* of the thermal head 3 is formed. The heat radiation plate 4 is extended from a head fixing portion 4*a* in a direction of a wide connecting portion 4*b* and a heat radiation portion 4*c* which are curved back and folded in a crank form.

Furthermore, the heat generated from the thermal head 3 during printing is immediately radiated by transferring the heat to the heat radiation portion 4*c* via the head fixing portion 4*a*.

Moreover, slit grooves 4*d* are formed in the center portion in the longitudinal direction of the head fixing portion 4*a*, as shown in FIG. 3, in direction orthogonal to the longitudinal direction of the heat radiation plate 4. The slit grooves 4*d* are formed at a predetermined interval, and a pressing portion 4*e* is located in the area of the head fixing portion 4*a* interposed between the slit grooves 4*d*.

In addition, a pressing position 4*f* of the pressing portion 4*e* indicated by a two-dot chain line is pressed by an adjusting member 12 which will be described later.

Also, two pressing positions 4*f*, 4*f*, indicated by the two-dot chain line, located in other portions besides the pressing portion 4*e* of the head fixing portion 4*a* can be pressed by other adjusting members 12.

Also, in the heat radiation plate 4, a circuit drawing opening 4*g* is formed with a predetermined size at the left side (as shown) of the connecting portion 4*b*. A forward protective cover 15 that forms circuit patterns may be connected to a plurality of heating elements of the thermal head 3 and drawn out from the circuit drawing opening 4*g*.

The thermal head 3 is supported at an end of a head supporting member 5 via the head radiation plate 4 and is movable toward or away from (head up/down) the platen roller 2.

Also, the head supporting member 5 is composed of a first head supporting member 6, made of a steel plate or the like and has first arm portions 6*a* that are substantially U-shaped and face each other. A second head supporting member 7, made of a steel plate or the like has second arm portions 7*a* that are substantially U-shaped and face each other in the outside opposite to the first arm portions 6*a*.

In the first head supporting member 6, an end (in the front of the drawing) of the first arm portions 6*a* is integrally formed with a flat plate head supporting portion 6*b*.

Also, a front side of the head supporting portion 6*b* is bent upwardly to form a reinforcing rib 6*c*, which improves strength.

Also, below the head supporting portion 6*b* of the first head supporting member 6, both ends in the longitudinal direction of the fixing portion 4*a* of the head radiation plate 4 are fixed by screw members 8. Also, in the second head supporting member 7, ends of the second arm portions 7*a* are bent at right angles with respect to the inner sides, and face each other to respectively form mounting portions 7*b*.

In the mounting portions 7*b*, an urging member 9 (FIG. 2) bent in a substantially L shape form is fixed by screws 10. A pair of the second arm portions 7*a*, 7*a* integrally connected.

Also, coil springs 11 are arranged between the urging member 9 and the head supporting portion 6*a* of the first head supporting member 6. The thermal head 3 mounted to the head supporting portion 6 via the heat radiation plate 4 is thus elastically urged to the platen roller 2.

Also, in the first head supporting member 6, stopper portions 6*d* are formed by being bent outward so as to prevent a gap from forming between the head supporting portion 6*b* and the urging member 9 by the urging force of the coil springs 11.

Also, the stopper portions 6*d* and the first arm portions 7*a* of the second head supporting member 7, whose gap is increased by the urging force of the coil springs 11, abut each other. The space between the head supporting portion 6*b* and the urging member 9 is not allowed to be increased over a predetermined size.

Because of this, the thermal head 3 supported by the head supporting portion 6*b* is always elastically urged toward the platen roller 2 located at the bottom.

Furthermore, in the head supporting portion 6*b* of the first head supporting member 6, the adjusting member 12 composed of three screw members is arranged at a predetermined interval within screw members 8, for example, by fastening screws at three positions.

By screwing the adjusting member 12 composed of the screw members screwed to the head supporting portion 6*b*, a pressing position 4*f* of the head fixing portion 4*a* indicated by a two-dot chain line is pressed downward.

Then, the head fixing portion 4*a* compressed by the adjusting member 12 can be curved naturally by slit grooves 4*d* for adjusting such that the pressing portion 4*e* in the center position becomes the highest convex position, having little strength.

Because of this, the first head supporting member 6 can prevent the warpage of the head supporting portion 6*b* even though the thickness of the head supporting portion 6*b* for supporting the adjusting member 12 is made thin, thereby the adjusting member 12 compresses the heat radiation plate 4.

Further, as shown in FIG. 2, if the fixing portion 4*a* is curved in the form of a mountain by screwing the adjusting member 12, the thermal head 3 is curved in the form of a mountain along the above curve.

Namely, the thermal head 3 is curved in a state that the head fixing portion 4*a* of the heat radiation plate 4 adheres closely to the thermal head 3. Therefore, heat reserve of the thermal head 3 generated during printing can immediately escape through the heat radiation plate 4.

Further, in the second head supporting member 7, urging portions 7*c* are respectively formed in a rod shape protruding outward from each end of the second arm portions 7*a*. The urging portions 7*c* are engaged with an urging member (not shown) arranged on the frame side.

In the head supporting member 5 like this, other ends of the first and second arm portions 6*a*, 7*a* are supported by a supporting shaft formed at the frame (not shown). If the urging portion 7*c* is pushed downward by the urging member 9, the front end of the head supporting member 5 rotates around the back end thereof as a fulcrum.

Also, if the end of the head supporting member 5 rotates downward, the thermal head 3 moves down and abuts the platen roller 2. If the thermal head 3 abuts the platen roller 2, the rotation of the first head supporting member 6 stops, but, the second head supporting member 7 rotates downward again.

By this, the head supporting portion 6*b* is elastically urged downward by the coil spring 11, thus the thermal head 3 pressure-contacts the platen roller 2 via the head radiation plate 4.

Further, in the thermal head 3 which pressure-contacts the platen roller 2, the central position of the longitudinal direction is bent downward as shown in FIG. 2 by about 70 μm, interposing the heat radiation plate 4 by the adjusting member 12. Because of this, an ink ribbon (not shown) that is drawn between the thermal head 3 and the platen roller 2 during printing, and is pressure-contacted to a recording paper, is prevented from being wrinkled.

In the thermal printer 1 of the present invention, as shown in FIG. 2, because the curve of the thermal head 3 is adjusted by the adjusting member 12 by using the heat radiation plate 4, the heat radiation plate 4 always adheres closely to the thermal head 3.

Because of this, heat generated from the thermal head 3 during printing operation is performed can reliably escape via the heat radiation plate 4.

Also, even though the thermal head 3 heats up during the printing process, the heat is immediately cooled down to an appropriate temperature for printing. It is, therefore, possible to print excellent quality images at a high rate of speed.

Further, in the preferred embodiment of the present invention, the head supporting member 5 was described as the combination of the first and second head supporting members 6 and 7, respectively, but the head supporting member 5 can be constructed by the first head supporting member 6 only so that the urging force is applied on the first head supporting member 6 to make it rotate.

Further, in the head fixing portion 4*a* of the head radiation plate 4 of the present invention, it was described that not only the pressing portion 4*e* interposed between the slit grooves 4*d* but also other portions are pressed by the adjusting member 12. But, as a modification of the heat radiation plate 4, relief holes may be formed in the pressing position 4*f* adjacent the pressing portion 4*e* as shown in FIG. 4. Only the pressing portion 4*e* of the center portion is pressed by the adjusting member 12, wherein the rest of the adjusting members 12 are positioned at the relief holes 4*h* so the thermal head 3 can be pressed.

By utilizing the heat radiation plate 4 according to a modification, for example, even though stress balance on the right and left side of the heat fixing portion 4*a* are differ from each other due to the circuit drawing opening 4*g*, the thermal head 3 can be appropriately bent in the form of a mountain uniformly from left and right sides by the adjusting member 12 pressing the pressing portion 4*e* of the center portion only.

What is claimed is:

1. A thermal printer comprising:

a rotatable platen roller;

an elongated thermal head which is movable toward or away from the platen roller;

a head supporting member having an elongated head supporting portion formed at an end thereof for supporting the thermal head;

an urging member for pressing the thermal head against the platen roller via the head supporting member;

a heat radiation plate through which heat generated from the thermal head during printing can escape is arranged between a head mount to which the thermal head is fixed and the head supporting portion; and an adjusting member arranged in the head supporting portion to adjustably curve the thermal head toward the platen roller via the heat radiation plate.

2. The thermal printer according to claim 1, wherein the heat radiation plate comprises a rectangular head fixing portion for fixing the thermal head, a heat radiation portion comprising a wide surface extending from the head fixing portion, wherein the head fixing portion is supported by the head supporting portion, and by curving the center portion of the head fixing portion along a longitudinal direction thereof with the adjusting member, the thermal head is adjustably curved.

3. A thermal printer according to claim 2, wherein the head fixing portion defines at least one slit groove formed in a center portion thereof in a direction orthogonal to the longitudinal direction of the head fixing portion, wherein the head fixing portion includes at least one pressing portion proximate the at least one slit groove to be pressed by the adjusting member.

4. A thermal printer according to claim 1, wherein the adjusting member comprises screw members screwed to the head supporting portion, and by screwing the screw members, the thermal head can be adjustably curved via the heat radiation plate.

5. A thermal printer according to claim 1, wherein the head supporting member comprises a pair of arm portions capable of supporting both ends of the longitudinal direction of the head supporting portion, the arm portion comprising a rotation supporting portion formed to be opposite to the head supporting portion, and by rotating around the rotation supporting portion as a fulcrum, the head supporting portion is movable toward or away from the platen roller.

6. A thermal printer according to claim 2, wherein the adjusting member comprises screw members screwed to the head supporting portion, and by screwing the screw members, the thermal head can be adjustably curved via the heat radiation plate.

7. A thermal printer according to claim 2, wherein the head supporting member comprises a pair of arm portions capable of supporting both ends of the longitudinal direction of the head supporting portion, the arm portion comprising a rotation supporting portion formed to be opposite to the head supporting portion, and by rotating around the rotation supporting portion as a fulcrum, the head supporting portion is movable toward or away from the platen roller.

8. A thermal printer according to claim 3, wherein the head supporting member comprises a pair of arm portions capable of supporting both ends of the longitudinal direction of the head supporting portion, the arm portion has a rotation supporting portion formed to be opposite to the head supporting portion, and by rotating around the rotation supporting portion as a fulcrum, the head supporting portion is movable toward or away from the platen roller.

9. A thermal printer according to claim 3, wherein the at least one slit groove comprises two slit grooves and the pressing portion is located therebetween.

10. A thermal printer according to claim 4, wherein the head fixing portion comprises additional pressing portions corresponding to the number and location of the screw members in the head supporting portion.

11. A thermal printer according to claim 10 wherein the additional pressing portions are relief holes defined in the head fixing portion.

12. A thermal printer according to claim 6, wherein the head fixing portion comprises additional pressing portions corresponding to the number and location of the screw members in the head supporting portion.

13. A thermal printer according to claim 12, wherein the additional pressing portions are relief holes defined in the head fixing portion.

* * * * *